US006702286B1

(12) United States Patent
Darak

(10) Patent No.: US 6,702,286 B1
(45) Date of Patent: Mar. 9, 2004

(54) WAR STRATEGY GAME

(76) Inventor: Varian Darak, N51 W17067 Shagbark Rd., Menomonee Falls, WI (US) 53051

( * ) Notice: Subject to any disclaimer, the term of this patent is extended or adjusted under 35 U.S.C. 154(b) by 0 days.

(21) Appl. No.: 10/101,986

(22) Filed: Mar. 18, 2002

(51) Int. Cl.[7] ..... A63F 3/00
(52) U.S. Cl. ..... 273/255; 273/283; 273/287
(58) Field of Search ..... 273/236, 242, 273/258, 260, 261, 282.1, 282.2, 283, 284, 287, 255

(56) References Cited

U.S. PATENT DOCUMENTS

| | | | | | |
|---|---|---|---|---|---|
| 957,800 | A | * | 5/1910 | Richarson | 273/264 |
| 1,196,748 | A | * | 8/1916 | Smith | 273/242 |
| 1,295,993 | A | * | 3/1919 | Kleissl | 273/241 |
| 3,495,831 | A | * | 2/1970 | Healy | 273/243 |
| 4,026,557 | A | * | 5/1977 | LeBrun et al. | 273/243 |
| 4,221,387 | A | * | 9/1980 | Carter | 273/236 |
| 4,260,158 | A | * | 4/1981 | Lohn | 273/267 |
| 4,486,021 | A | * | 12/1984 | Karas, Jr. | 273/255 |
| 5,002,282 | A | * | 3/1991 | Hanley | 273/236 |
| 5,069,458 | A | | 12/1991 | Washington | 273/238 |
| 5,145,182 | A | | 9/1992 | Swift et al. | 273/238 |
| D356,604 | S | * | 3/1995 | Miccio | |
| 5,437,460 | A | | 8/1995 | Cho | 273/262 |
| 5,690,333 | A | | 11/1997 | Danner et al. | 273/260 |

OTHER PUBLICATIONS

"Rules for Medieval Games", Internet web printout, admitted prior art.
"Tafl", Internet web printout, admitted prior art.

* cited by examiner

*Primary Examiner*—Benjamin H. Layno
*Assistant Examiner*—Vishu K Mendiratta
(74) *Attorney, Agent, or Firm*—Andrus, Sceales, Starke & Sawall, LLP

(57) ABSTRACT

The present invention pertains to a war strategy game played on an octagon shaped polar matrix of eight radial paths and four latitudinal paths. Each radial path intersects each latitudinal path to define an array of playable positions. Each player is given nine pieces to place on the matrix at the start of the game. Each player moves one piece during each turn. Pieces move from one position to another along one radial or one latitudinal path. Players capture an opposing piece by occupying two opposed adjacent positions of that opposing piece. The matrix is combined with one or more other like-shaped matrixes to form a variety of city or battlefield settings. Two radial paths of each matrix join two corresponding radial paths of an abutting matrix. The city battlefield settings provide elongated radial paths or roadways along which the pieces move from one matrix to another.

9 Claims, 16 Drawing Sheets

WAR STRATEGY GAME

TECHNICAL FIELD OF THE INVENTION

The present invention relates to a war strategy game played on a polar matrix of intersecting radial and latitudinal paths that define an array of playing positions, where playing pieces move along those paths to flank and capture opposing playing pieces, and where several matrixes can be aligned to form a variety of city or battlefield layouts.

BACKGROUND OF THE INVENTION

A wide variety of strategy games have been developed and played over the years. Many of these games date back hundreds of years, such as Hnefatafl, Fox and Geese, Nine Man Morris, Go, Othello, Tick-Tac-Toe, Checkers and Chess. Each game has a board with an array of positions on which the players move their pieces during the course of play. The objective of the game is typically to capture all the pieces or a certain piece of your opponent. Examples of some more modern games are disclosed in U.S. Pat. No. 5,069,458 to Wahington, U.S. Pat. No. 5,145,182 to Swift, U.S. Pat. No. 5,437,460 to Cho and U.S. Pat. No. 5,690,333 to Danner the disclosures of which are incorporated by reference.

Strategy games can differ in a variety of ways. For example, the boards can contain different layouts or fields of positions. Each player can have the same or a different number of playing pieces. Each player can have the same or different kinds of playing pieces with superior strengths or capabilities. Playing pieces can be placed on the board at the start of the game or throughout the game. The playing pieces can move in a wide variety of ways on their respective boards. Players can capture the opposing pieces by moving their pieces to jump, surround or occupy the same position as the opposing pieces. Some games are limited to two players and others allow two or more players. Each of these variations affects the strategy of play and the degree of skill required to play the game against a knowledgeable opponent.

Game designs should produce a balance between the opposing players or sides. Neither player should have a significant advantage over the other simply based on which side or set of pieces they are playing or who goes first. The combination of board size and geometry, the types and number of playing pieces, the layout of the interconnecting playable positions, the manner each piece moves on the board, the manner of capture and the number of allowable players should all be taken into consideration when designing a strategy game.

Game designs should involve a desired degree of skill and variation of possible moves and outcomes. If the board layout, types and number of pieces, rules of movements and rules of capture are too simple the game will be so easy to learn and play in a skilled or logical manner that each person knows the best moves and countermoves. The players master the game so quickly that the game usually ends in a draw or predictable manner and becomes uninteresting. If the board size and layout, number and kinds of pieces and rules of movement and capture are too complicated the game can take too long to learn to a competitive level. The more skilled player repeatedly wins the game, which become frustrating for everyone.

Game designs should accommodate different numbers of players. Many games must be played by two and only two players. This is a problem when three or more people all want to play the same game, or when only one game is available. Other games require or are intended for three or more players. The game becomes more and more predictable and less skill is involved when there are only two or three players. Games that adjust to accommodate a variety of players, provide more opportunities to play, and are more rewarding to those that invest the time to learn and master the game.

More challenging games frequently require a significant investment in time before they can be played at a competent level. Complicated board layouts or rules of movement cannot be broken down into smaller components to facilitate learning the game. Unless a person can commit a significant amount of time to learn every aspect of the game, they will simply avoid learning the game altogether.

The present invention is intended to solve these and other problems.

BRIEF DESCRIPTION OF THE INVENTION

The present invention pertains to a war strategy game played on an octagon shaped polar matrix of eight radial paths and four latitudinal paths. Each radial path intersects each latitudinal path to define an array of playable positions. Each player is given nine pieces to place on the matrix at the start of the game. Each player moves one piece during each turn. Pieces move from one position to another along one radial or one latitudinal path. Players capture an opposing piece by occupying two opposed adjacent positions of that opposing piece. The matrix is combined with one or more other like-shaped matrixes to form a variety of city or battlefield settings. Two radial paths of each matrix join two corresponding radial paths of an abutting matrix. The city battlefield settings provide elongated radial paths or roadways along which the pieces move from one matrix to another.

One advantage of the present war strategy game is its balance between opposing sides of play. Neither player has an advantage simply based on the side or set of pieces they play or who goes first. The symmetry of the board, the equal number of playing pieces and the fact the pieces move and capture opposing pieces in the same manner combine to provide a challenging well balanced strategy game that rewards skillful play.

Another advantage of the game is that it requires strategy to play in a skilled manner. The geometry of the matrix or matrixes of pathways and labyrinth of interconnected playing positions encourage players to coordinate small squads or packs of pieces to capture one or more pieces of the other player or players. Larger scale assaults are difficult or impractical to coordinate. Hit and run tactics by smaller squads tend to be more successful, particularly in more complex multi-board battlefield settings. These squads can easily disperse through the catacomb of pathways and pack hunt the pieces of the other player. Pieces that are cut off from their squad are more easily surrounded and captured. Players have the challenge of simultaneously coordinating several squads that can attack, retreat and regroup throughout the game.

A further advantage of the present war strategy game is its variation of possible moves and outcomes. The board layout and piece movements allow a wide variety of skilled piece movements. Each piece can move and strike an opponent along several paths. Similarly, each piece is vulnerable to attack from their opponent from several directions. The squad movements must be coordinated to attain defensive and offensive position. A variety of sound movement strategies can be successfully employed. There is rarely a single best move, series of moves or countermoves. Skilled players must adjust their strategy to capitalize on the weaknesses of the present positions and strategies of their opponent or opponents.

A still further advantage of the present war strategy game is how quickly a player can gain or lose a seemingly advantageous offensive or defensive position. Players can quickly move packs of pieces from one side of a single board matrix or complicated battlefield matrix to the other. The geometry of each matrix allows each piece to move along three different paths to the other side of that matrix, unless blocked by another piece. Battlefield settings are typically arranged with elongated radial paths that allow pieces to move from one area or side of the city battlefield to the other in a single turn. Transport towers provide an additional mechanism for moving pieces from one end of the city to the other. The ability to move pieces long distances along several different paths provides for a fast moving game that require the constant attention of each player. An advantageous position can quickly swing to favor the opponent, and visa versa.

A still further advantage of the present war strategy game is its ability to accommodate different numbers of players or control the likely length of the game. The game is played by two players on a single board in a relatively short period of time. Additional boards are added to accommodate more players, or increase the difficulty or length of time to play the game. Large multiple board cities or battlefields are set up to accommodate several players. The game also accommodates team play. Skilled, intermediate and novice players can be divided up to form equally balanced teams.

A still further advantage of the present war strategy game is that piece movements are relatively easy to learn, and the game can be learned in incremental steps. Each piece moves along a single path of travel along one radial path or one latitudinal path during each turn. This same piece movement applies to all the pieces. Players can quickly become comfortable with single board play before they advance to learn the intricacies of multiple board battlefield layouts. After they becomes comfortable with the tactics of middle size battlefield layouts, they can advance to more complicated layouts involving several players or teams of players. Players can enjoy each level of play before advancing, and can learn at a rate that accommodates their schedule.

Other aspects and advantages of the invention will become apparent upon making reference to the specification, claims and drawings.

DESCRIPTION OF THE PREFERRED EMBODIMENTS

While this invention is susceptible of embodiment in many different forms, the drawings show and the specification describes in detail a preferred embodiment of the invention. It should be understood that the drawings and specification are to be considered an exemplification of the principles of the invention. They are not intended to limit the broad aspects of the invention to the embodiment illustrated.

Figure 1:
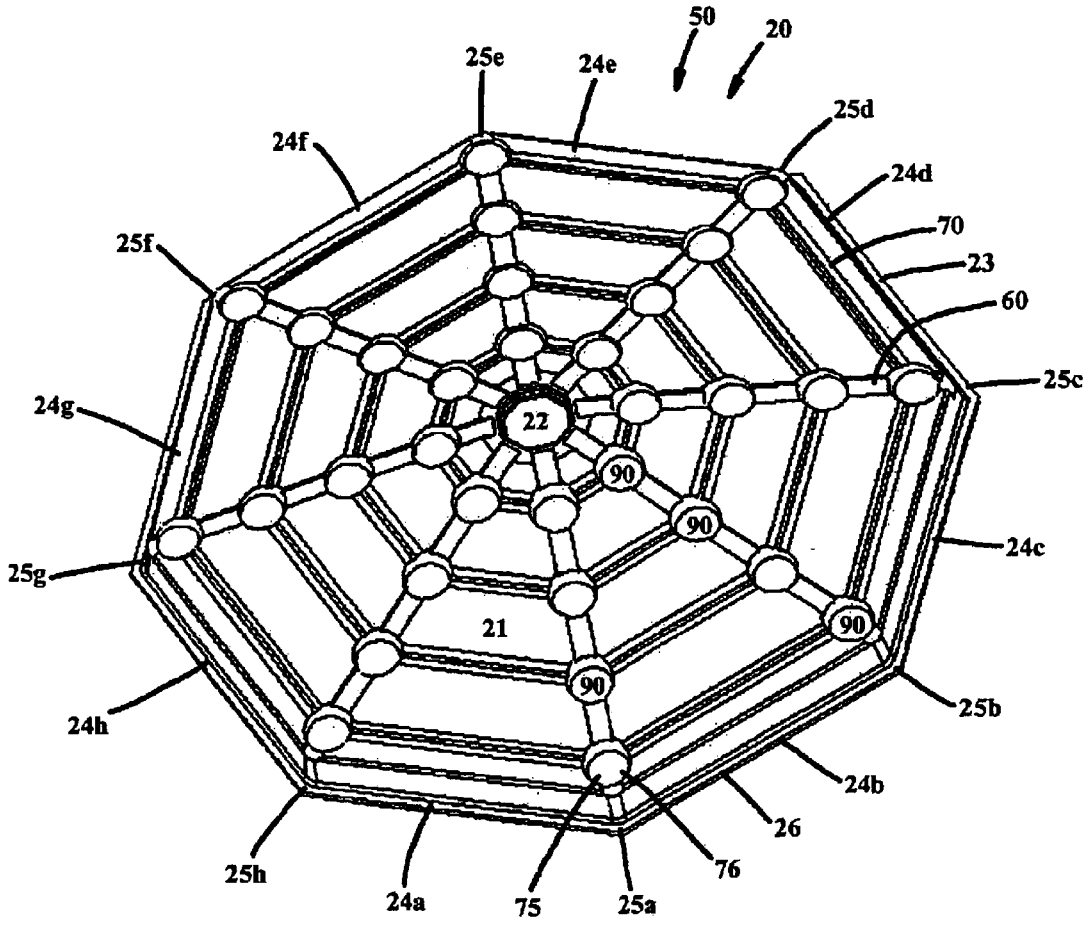
FIG. 1 is a perspective view of a single octagon shaped board with a polar matrix of radial and latitudinal paths that define its center and perimeter.
Figure 1A:
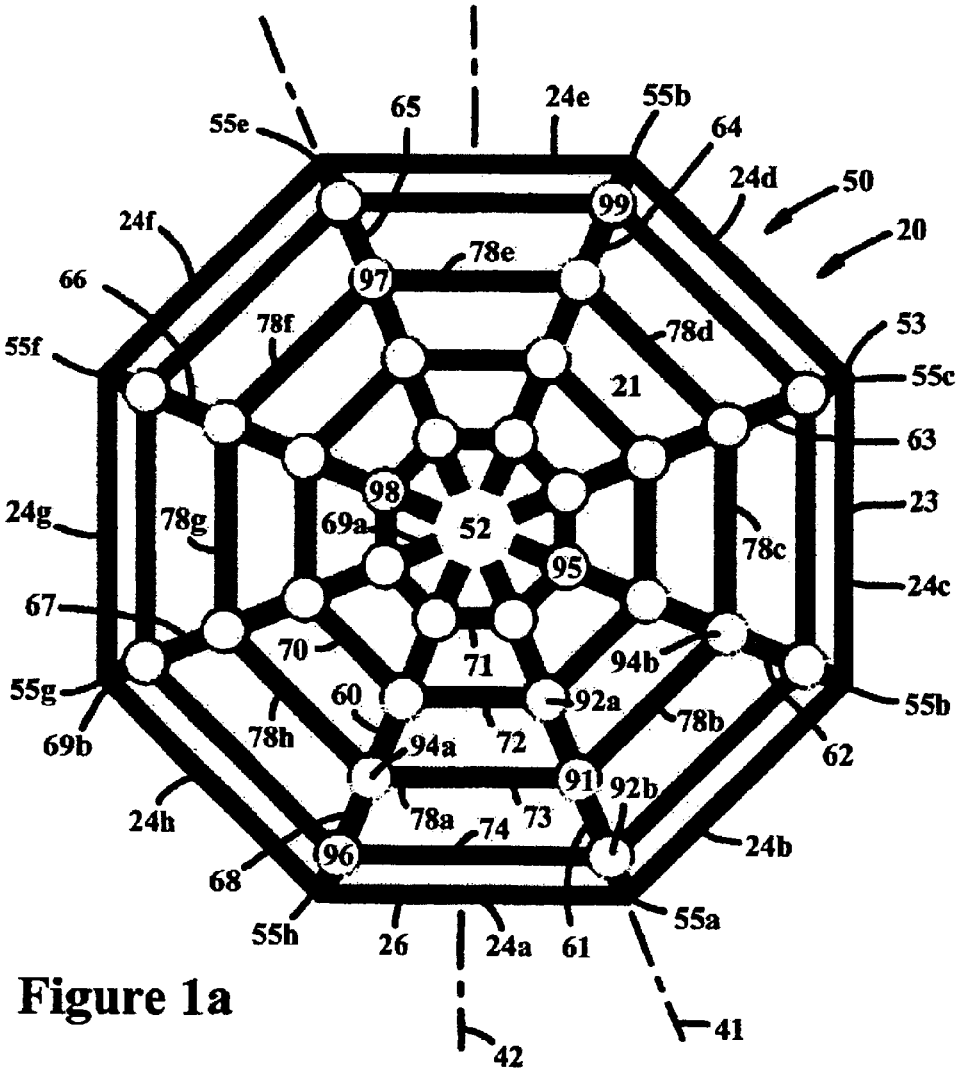
FIG. 1*a* is a top view of the single board showing its polar matrix of radial and latitudinal paths.
Figure 1B:
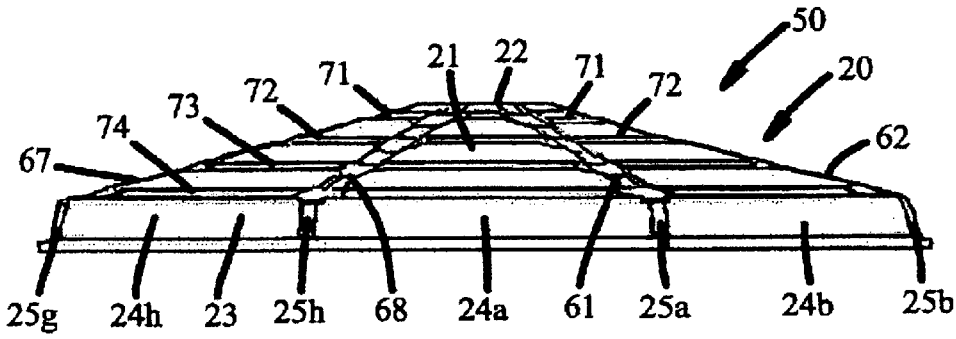
FIG. 1*b* is a side view of the single board showing its pyramid shape and elevated center.

The present invention relates to a strategy game generally indicated by reference number 10 and shown in FIGS. 1–12. The game 10 is generally played on one or more playing surfaces such as one or more boards 20, but is amenable to play on other surfaces such as a computer screen. As shown in FIGS. 1, 1*a* and 1*b*, each board 20 has a top surface 21 with a center 22 and a perimeter 23 formed by several sides 24. The board 20 preferably has an octagon shaped perimeter with eight sides 24*a*–24*h* of equal length. Two adjacent sides 24 meet to form one of the eight, evenly spaced, corners 25*a*–25*h* around the perimeter 23 of the board 20. Each corner 25 forms a 135° angle. Each side 24 forms a straight boarder segment between its two ends or corners 25, and has a midpoint between those corners. The center 22 of the board 20 is elevated from its perimeter 23 to house the electrical components and lights for the game 10. The even number of sides 24 give the board 20 a degree of symmetry. Each side 24 has a diametrically opposed side, and each corner 25 has a diametrically opposed corner. For example, sides 24*a* and 24*e*, and corners 25*a* and 25*e* are diametrically opposed. The octagon shaped board 20 has eight lines of symmetry. One line of symmetry 41 passes through each of the four pair of diametrically opposed corners 25. One additional line of symmetry 42 passes through each of the four pair of diametrically opposed midpoint of sides 24.

Although the preferred embodiment of the game 10 is shown and described to be played on one or more substantially two-dimensional, octagon shaped boards 20, it should be understood that the game could be played on boards having more or less than eight sides or a three dimensional board formed by two or more playing surfaces, without departing from the broad aspects of the invention. For example, the playing surface could be formed by two hemispherical shaped boards joined together to form a spherical playing surface, or a number of boards joined together to form a spherical, soccer ball shaped playing surface. In addition, in situations such as when the game 10 is played on a single board 20, the perimeter 23 of the board could be circular without departing from the invention.

The top surface 21 of the board 20 displays a polar matrix or hive of pathways 50 with a generally spider web appearance as shown in FIG. 1*a*. The matrix 50 has a center 52 and a perimeter 53 with eight corners 55 that generally coincide with the center 22, perimeter 23 and corners 25 of the board 20, respectively. The matrix 50 overlays the top of the board 20, and is symmetrical for the reasons discussed above and other reasons discussed below.

The polar matrix 50 has a set of radial paths 60 that preferably includes eight paths 61–68. Each radial path 61–68 is in line with and emanates from an end 69*a* at or near the center of the matrix 50. Each radial path 61–68 extends linearly toward and has a terminal end 69*b* at one of the corners 55 of its perimeter 53. The radial paths 60 are uniformly space apart around the circumference of the matrix 50. Each radial path 61–68 forms a 45° angle with each of its two adjacent radial paths. For example, radial path 61 forms a 45° angle with radial path 68 and a 45° angle with radial path 62. The matrix 50 and its radial paths 60 are symmetrical. Each path has an opposed radial path that is in linear alignment. For example, radial path 61 is in linear alignment with its opposed radial path 65.

The polar matrix 50 has a set of latitudinal paths 70 that preferably includes an inner path 71, two intermediate paths 72 and 73, and an outer path 74. Each latitudinal path 70 encircles the matrix 50 and is spaced a substantially uniform distance from its center 52. The latitudinal paths 71–74 are uniformly spaced apart from their adjacent latitudinal path or paths. Although they are preferably octagon shaped, each latitudinal path 70 is spaced a specific, substantially uniform, distance from the center 22 or 55 of the board 20 or matrix 50. The radius of the inner path 71 is roughly one-fourth of the radius of the matrix 50. The radius of the first and second intermediate paths 72 and 73 are roughly one-half and three-fourths of the radius of the matrix 50, respectively. The radius of the outer path 74 is slightly less than the radius of the matrix 50.

Each latitudinal path 70 intersects all eight radial paths 60. The intersection of one radial path 60 and one latitudinal path forms a point of intersection 75. As the preferred embodiment of the matrix 50 has eight radial paths 60 and four latitudinal paths 70, the matrix has thirty-two points of intersection 75. Each intersection has an opening 76 for receiving a playing piece as discussed below. Although the preferred polar matrix 50 is shown and described as having eight radial paths 60, four latitudinal paths 70 and thirty-two playing positions 90, it should be understood that the number of paths and playing positions on a given matrix could increased of decreased without departing from the broad aspects of the invention.

Each latitudinal path 70 is formed by eight linear segments 78. Each segment 78 connects two adjacent points of intersection 75 on its latitudinal path 71–74. The segments 78 forming a given path 71, 72, 73 or 74 are each of equal size relative to the other segments in that path. The segments 78 in the inner path 74 are shorter than the intermediate paths 72 or 73, which are shorter than the outer path 74. Each latitudinal path 71–74 has the same number of occupiable positions 90. Although each latitudinal path 70 is shown and described as being formed by linear segments 78, it should be understood that these segments could be curved or arcuate so that one or more of the latitudinal paths has a circular or wavy shape without departing from the broad aspects of the invention. The latitudinal paths 71–74 could also be interconnected to form an inwardly converging spiral.

The radial and latitudinal paths 60 and 70 divide the board into a number of sectors or areas. The region or zone between two adjacent radial paths 60 defines one radial sector 82. The eight radial paths 60 divide the board 20 and matrix 50 into eight, pie-shaped, radial sectors 82. Each radial sector 82 has one 45° angle at the center 52 of the matrix 50, and two 67.5° angles at each of its two corresponding corners 55 along its perimeter 53. The region between two adjacent latitudinal paths 70 defines one latitudinal areas 84. The four latitudinal paths 70 divide the board 20 or matrix 50 into three donut shaped latitudinal areas 84.

The points of intersection 75 of the radial and latitudinal paths 60 and 70 define an array of occupiable playing positions 90. As stated above, the preferred embodiment of the board 20 and matrix 50 has thirty-two playing positions. Each occupiable position 90 has three or four adjacent positions, and one or two sets of opposed adjacent positions. As shown in FIG. 1*a*, a position 91 on one of the intermediate latitudinal paths has two sets of opposed adjacent positions 92 and 94. The first set of opposed radially adjacent positions 92 is formed by positions 92*a* and 92*b*. The second set of opposed latitudinally adjacent positions 94 is formed by positions 94*a* and 94*b*. Positions 95 and 96 on the inner and outer latitudinal paths 71 and 74 only have one set 94 of opposed adjacent positions 94*a* and 94*b*. These paths 71 and 74 have only one radially adjacent position. The symmetry of the polar matrix 50 dictates that each occupiable position 90 has a diametrically opposed position. For example, positions 91, 95 and 96 have diametrically opposed positions 97, 98 and 99, respectively.

When the strategy game 10 is played on a single board 20 or matrix 50 with thirty-two playing positions 90 as in FIGS. 1–6, the game is intended for two players. Each player preferably receives nine playing pieces or squibbs 100 at the start of the game 10. Each player receives a set of pieces 102 or 104 that is distinguishable from those of the other player. Each piece 100 preferably has the same general shape and is capable of fitting into any opening 76 at any playable position 90. The sets of pieces 102 and 104 are distinguishable because each set of pieces has a different color or color pattern. For example, the first set of pieces 102 can be red, and the second set of pieces 104 can be green.

Figure 2:
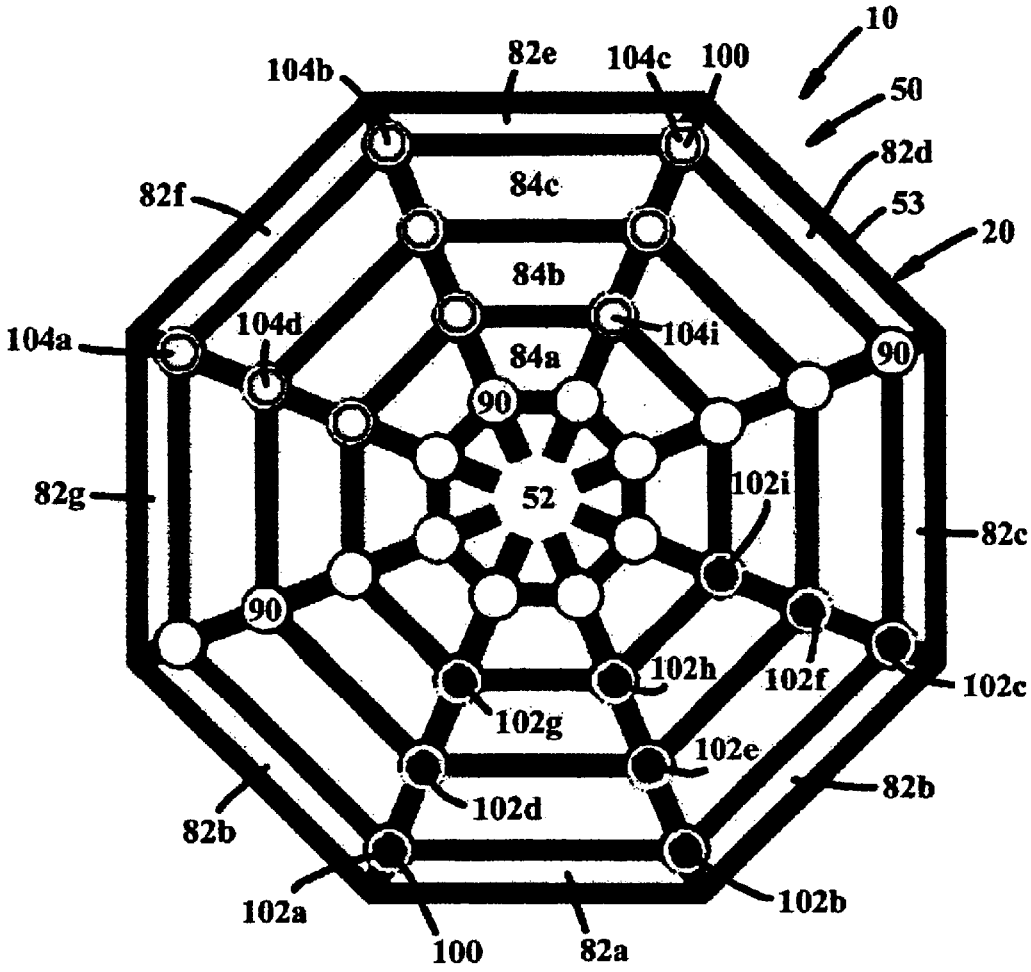
FIG. 2 is a top view of the single board showing the pieces of two opposing players arranged at the start of play.

At the start of the game 10, each player places his or her pieces 102 or 104 on opposite sides 24 of the board 20 or matrix 50 from the opposing player as shown in FIG. 2. Each player places his or her set of pieces 102 or 104 in a cluster of playing positions 90 in an area formed by two adjacent radial sectors 82 and two adjacent latitudinal sectors 84. Although each player is shown and described as initially receiving nine playing pieces 100 at the start of the game, it should be understood that the players could receive fewer or more pieces without departing from the broad aspect of the game, or some of the pieces could be received at a time other than the start of the game.

Once the sets of pieces 102 and 104 are placed on the board 20 or matrix 50, the game 10 is ready to begin. To determine which player has the opening move, one player hides a red piece 102 in one hand and a green piece 104 in the other hand. The opposing player chooses, and the color of the piece 102 or 104 that is chosen moves first. The players take turns moving their pieces 102 or 104 during play. Each player moves one of his or her pieces 102 or 104 during each turn.

Figure 3:
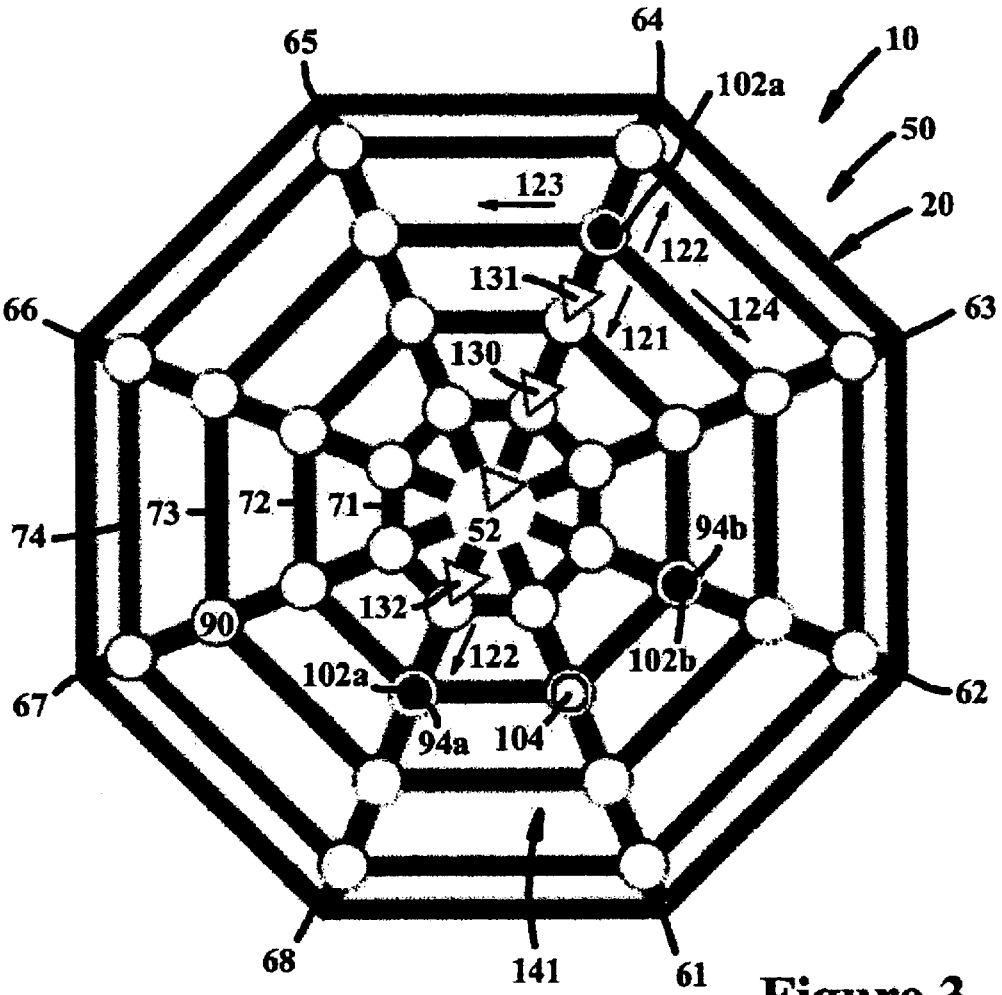
FIG. 3 is a top view of the single board showing one piece moving along one radial path over the center of the board to its opposite radial path to combine with another piece to form a latitudinal flank on and capture an opposing piece.

Each piece 100 moves in an equivalent manner subject to the particular position 90 it occupies at the start of the turn and the location of the other pieces 102 and 104 on the board 20 or matrix 50. Each position 90 has several possible paths of travel available to any piece 100 placed on that position. Each playing piece 100 can move from its present position 90 along its adjoining radial path 60 or either of its latitudinal paths 70. In other words, the piece 100 can move along one of either the radial or the longitudinal paths that intersect at its present position 90. Pieces 100 on the inner and intermediate latitudinal paths 71–73 can move in one of four possible directions 121–124 as shown in FIG. 3. Pieces 100 on the outer latitudinal path 74 can only move in one of three possible directions 121, 123 or 124. The piece 100 can move in either of two radial directions 121 or 122 along its radial path 60, or in either of two latitudinal directions 123 or 124 along its latitudinal path 70. The piece 100 can move radially inwardly 121 toward the center 52 of the matrix 50, radially outward 122 toward the perimeter 53 of the matrix, latitudinally to the right 123 or latitudinally to the left 124. Pieces 100 are not permitted to move off the matrix 50, or land on or pass over any other friendly 102 or opposed 104 piece. Thus, each possible path of travel can have a more limited permitted path of travel.

Each player moves one piece 100 along a selected path of travel 130 each turn. The player chooses which of his or her pieces 102 or 104 to move on the board 20 or matrix 50, and its selected path of travel 130. The selected path of travel 130 is one of the permissible paths of travel available to the piece 100 as dictated by the position 90 that piece occupies at the start of the turn and the location of the other pieces 102 and 104 on the matrix 50 at the start of that turn. The selected path of travel 130 extends in one radial or latitudinal direction 121, 122, 123 or 124 starting from that initial or present occupied position 90 of the piece at the start of the turn. The selected path of travel 130 can extend one path segment to an adjacent radial 92 or latitudinal 94 position or encompass any permissible number of path segments and playing positions 90 in the selected radial or latitudinal direction 121, 122, 123 or 124. As noted above, the moving piece 102*a* cannot land on or pass over any other friendly 102 or opposed 104 piece or occupied position 90. The selected path of travel 130 must end at one of the unoccupied positions 90 before reaching another piece 100.

The permissible paths of travel extend along an inward radial path 131, an outward radial path 132, a right longitudinal path 133 or a left longitudinal path 134. The pieces 100 are permitted to move over the center 52 of the matrix 50, but cannot land on or occupy the center. When the selected path of travel 130 is along the radial path 60 of the piece 100, the piece can travel in either radial direction 121 or 122 to any unoccupied position on that radial path 60, unless blocked by another piece. When the selected path of travel 130 is the inward radial path 131, such as along radial path 64, the piece 100 can travel over the center 52 of the matrix 50 in a straight line to its opposed radial path, such as radial path 68, and continue along the outward radial path 132 of that opposed radial path. The piece 100 can land on or end its movement on any unoccupied position 90 of that opposed radial path.

When the selected path of travel 130 is along the latitudinal path 70 of the piece 100, the piece can move along the selected path of travel 130 in either latitudinal direction 123 or 124 to any unoccupied position on that latitudinal path 70, unless blocked by another piece. The piece 100 can return to the same position from which it started its move provided a path leading back to the start position is available. A player cannot elect to skip his or her turn. As discussed above, each playing position 90 has a diametrically opposed position. The permissible paths of travel from each position 90, and thus of each piece 100, include three different directions 121, 123 or 124 and corresponding paths 131, 133 or 134 along which the piece can move to reach its diametrically opposed position. The selected path of travel 130 can be any one of these three permissible paths of travel.

As stated above, the goal of the game 10 is to capture or otherwise eliminate the pieces 100 of the opposing player. The first player uses his or her pieces 102 to capture the pieces 104 of the second player, and visa versa. Playing pieces 100 are captured when they are flanked by two opposing pieces 102 or 104. The piece 100 is flanked when two opposing pieces 102 or 104 occupy one set of opposed adjacent positions 92*a* and 92*b* or 94*a* and 94*b* of that piece. For example, FIG. 3 shows the moving piece 102*a* traveling along its selected path of travel 130 from its initial position 90, along inward radial path 131 of radial path 64, over the center 52 of the matrix 50 to its opposed radial path 68, and along outward radial path 132 to land on an end position 94*a* of radial path 68. The moved piece 102*a* combines with another friendly piece 102*b* at position 94*b* on the same latitudinal path 72 to form a latitudinal flank 141 of opposing piece 104. This is deemed a single piece capture or single flank 141 because only one piece is captured or eliminated. The captured or eliminated piece 104 is removed from the board 20.

Figure 4:
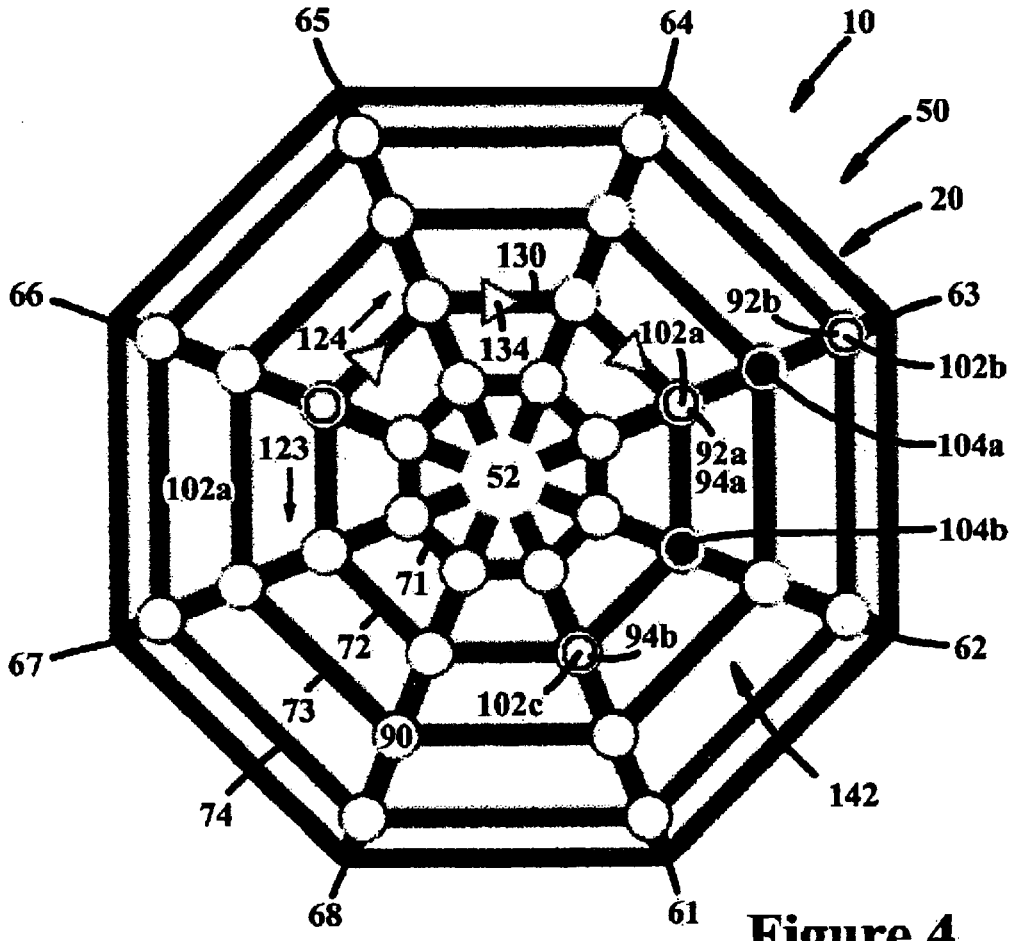
FIG. 4 is a top view of the single board showing one piece moving along one latitudinal path to combine with two other pieces to form a double flank on and simultaneously capture two opposing pieces.

The geometry of the matrix 50 and allowable piece movements enable each player to capture one, two or three opposing pieces 104 during a single turn. The players can also sacrifice the piece 102*a* they are moving. The single flank or capture 141 is discussed above. A double flank 142 is shown in FIG. 4. The moving piece 102*a* moves from its initial position on latitudinal path 72 along its selected path of travel 130 position 92*a*, 94*a* to combine with two other pieces 102*b* and 102*c* at positions 92*b* and 94*b*, respectively, to form a double flank 142 on opposing pieces 104*a* and 104*b* to simultaneously capture both opposing pieces. Pieces 102*a* and 102*b* form a radial flank on piece 104*a*. Pieces 102*a* and 102*c* form a latitudinal flank on piece 104*b*.

Figure 5:
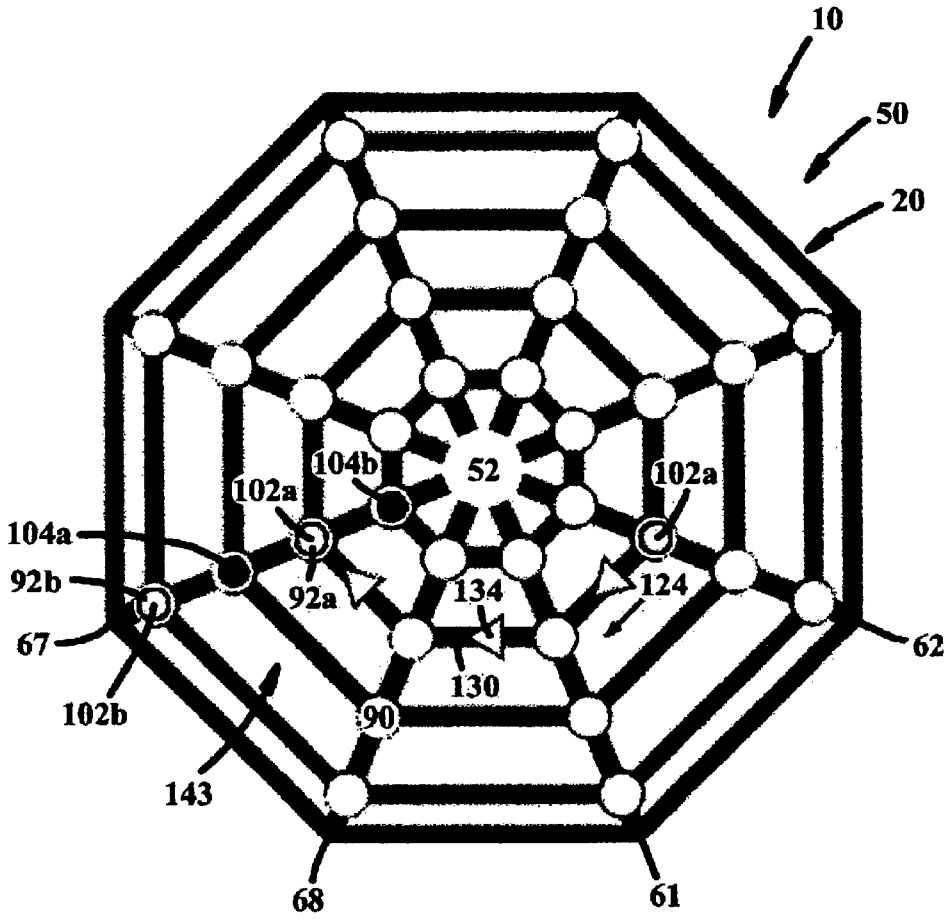
FIG. 5 is a top view of the single board showing one piece moving along one latitudinal path to combine with another piece to form a sacrificial flank on one opposing piece to simultaneously capture the opposing piece and sacrifice the piece being moved.
Figure 6:
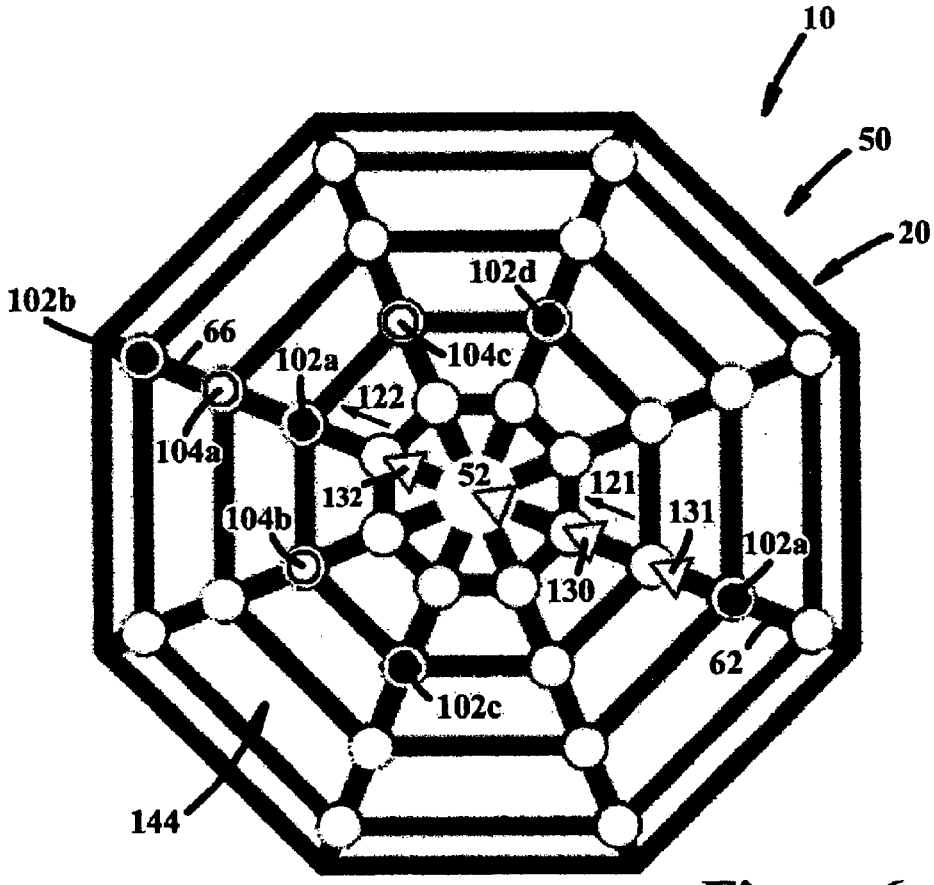
FIG. 6 is a top view of the single board showing one piece moving along one radial path over the center of the board to its opposite radial path to combine with three other pieces to form a triple sacrificial flank that simultaneously captures three opposing pieces and sacrifices the piece being moved.

A sacrificial flank 143 is shown in FIG. 5. The moving piece 102*a* moves from its initial position on latitudinal path 72 along its selected path of travel 130 to position 92*a* to combine with another piece 102*b* at position 92*b* to flank one of the opposing pieces 104*a*. The moved piece 102*a* is also simultaneously sacrificed because it is flanked by opposing pieces 104*a* and 104*b*. Both the captured piece 104*a* and the sacrificed piece 102*a* are removed from the board 20. A triple sacrificial flank 144 is shown in FIG. 6. The moving piece 102*a* moves from its initial position on radial path 62 along its selected path of travel 130 over the center 52 of the matrix 50 to its opposite radial path 66 to combine with three other pieces 102*b*, 102*c* and 102*d* to form a triple sacrificial flank 144 that simultaneously captures three opposing piece 104*a*, 104*b* and 104*c*, and sacrifices the moved piece 102*a*. A double sacrificial flank (not shown) would occur if any one of the pieces 102*b*, 102*c* or 102*d* were removed.

The game 10 continues with the players taking alternating turns until one player eliminates all, or all but one, of the pieces 102 or 104 of the opposing player. Players with only one piece 102 or 104 are unable to flank and capture opposing pieces. One restriction of piece movement is that a player may not move all of his or her pieces 102 or 104 on an inner or outer ring 71 or 74 except to capture one or more of the opposing pieces. This rule is not necessary for team play on multiple-board layouts as discussed below.

Figure 7:
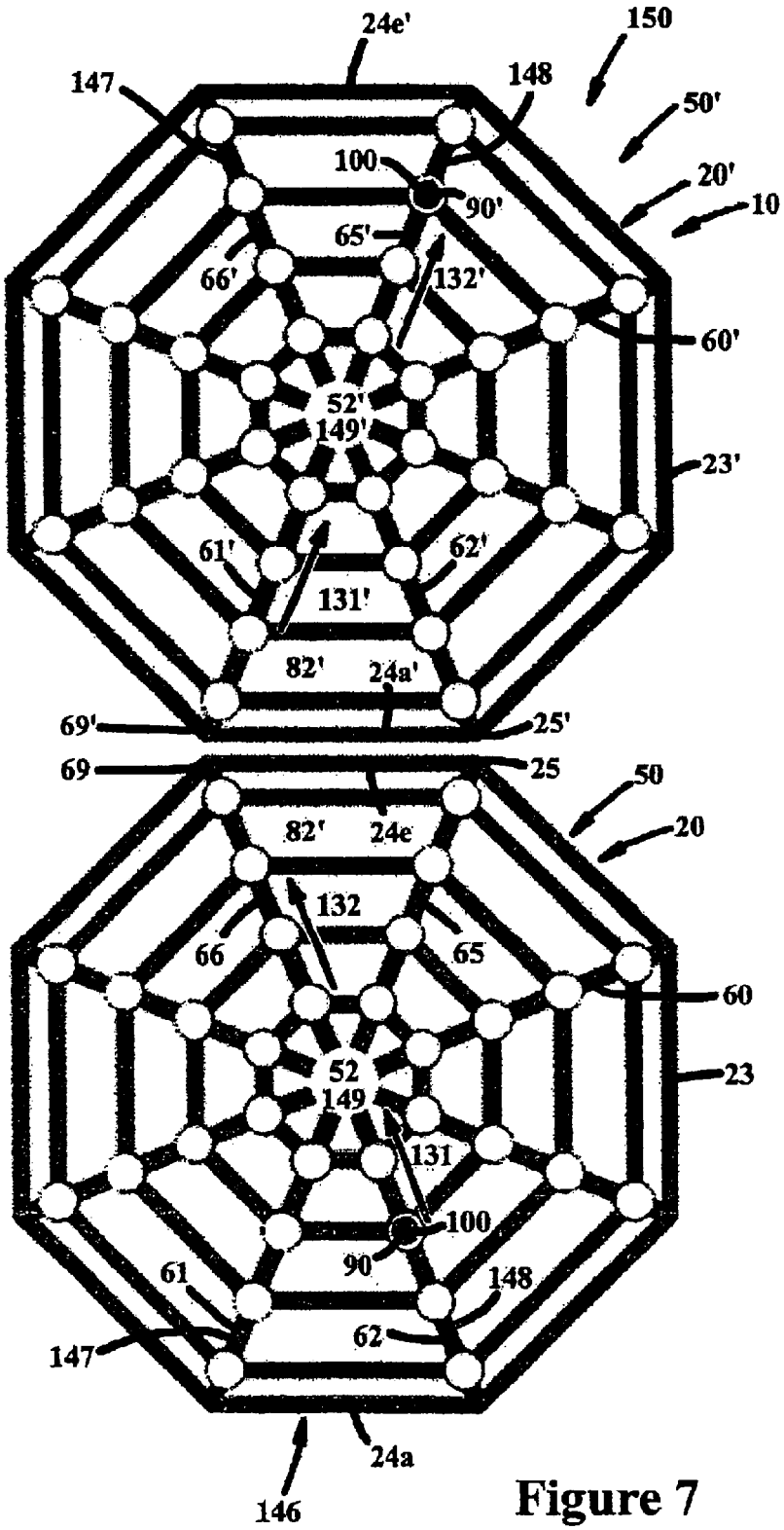
FIG. 7 is a top view showing two abutting boards and connected matrixes and a pair of crisscrossing radial paths along which the pieces move from one matrix to the other.

Two boards or hives 20 and 20' are joined together in FIG. 7. The boards 20 are placed in a side-by-side relationship to join or otherwise link their matrixes 50 and 50' together. One side segment 24 of board 20 abuts a corresponding side segment 24' of the abutting board 20'. Abutting side segments 24*a* and 24*e'* are flushly aligned so that their corners 25 and 25' meet. Each abutting side segment 24*a* and 24*e'* has a corresponding radial sector 82 or 82' bound by two adjacent radial paths 65 and 66 or 61' and 62'.

The outer end 69*b* of each of the adjacent radial paths 65 and 66 of matrix 50 flushly meets or otherwise interconnects with the outer end 69*b'* of its corresponding radial path 61' or 62' of the abutting matrix 50'. The two sets of interconnecting radial paths 65 and 62' and 66 and 61' join or interconnect the abutting matrixes 50 and 50'. Each of the radial paths 65 and 66 on board 20 connects with its corresponding radial path 62' or 61' on the abutting board 20'. Although the boards 20 and 20' are shown and described as having perimeters 23 and 23' formed by straight side segments 24 and 24', it should be understood that the perimeter could take on other shapes without departing from the broad aspects of the invention. For example the perimeters 23 and 23' could have a wavy or flower shape. Each of the sectors 80 and 80' could have a pelatine shape forming one flower petal. The radial paths 60 and 60' could have terminal ends 69*b* and 69*b'* at the peaks, midpoints, troughs or points where adjacent waves or petals intersect.

The pieces 100 move from one board 20 or matrix 50 to its abutting board 20' or matrix 50' by moving from one radial path 65 or 66 to its corresponding interconnected radial path 62' or 61'. The pieces 100 can move from any position 90 on one radial path 65 or 66 to any position on its corresponding interconnected radial path 62' or 61', respectively. The pieces 100 can move over the center 52 of one or both interconnected matrixes 50 and 50' in a single turn. For example, one possible path of travel 130 includes moving the piece 100 from its present position 90 on one radial path 62 of matrix 50 along inward radial path 131, over the center 52 of that matrix, along outward radial path 132 of opposed radial path 66, to an abutting matrix 50' via its corresponding radial path 61', along radial inward path 131', over the center 52' of the abutting matrix 50' to its opposed radial path 65', and along radially outward path 132' to one of the positions 90' on the opposed radial path 65' of the abutting matrix.

A pair of crisscrossing radial paths 146 are formed by 61, 65, 62' and 66' and radial paths 62, 66, 61' and 65' The crisscrossing radial paths 146 includes first and second paths 147 and 148. These linear paths 147 and 148 allow the piece 100 to move from one side of one board 20 or matrix 50 to an opposed side of the abutting board 20' or matrix 50' in a single turn. Elongated path 147 includes radial paths 61, 65, 62' and 66'. Elongated path 148 includes radial path 62, 66, 61' and 65'. The crisscrossing elongated radial paths 147 and 148 intersect each other at points of intersection 149 coinciding with the centers 52 and 52' of the two boards 20 and 20'.

Several boards or hives 20 are joined or linked together to form any of a variety of city battlefield layouts 150 as shown in FIGS. 8–11. Each board 20 abuts at least one other board 20', and up to as many as four other boards, in a manner described above. In city layouts 150 formed by octagon shaped boards 20, the side 24 of one board 20 can abut any of the eight sides of its adjacent board 20'. The adjacent side segments 24 of one board 20 cannot abut two adjacent boards 20' and 20". For example, the adjacent side segments 24*a* and 24*b* of one board 20 cannot each abut an adjacent board 20' and 20".

The geometry and symmetry of the octagon shaped boards 20 allow them to be assembled in a wide variety of layouts or patterns 150. Only a few boards 20 are needed to form less complicated layouts, such as a smaller generally linear layout 151 as in FIG. 8. Additional boards 20 are added to increase the complexity and difficulty of the layout 150. The boards 20 are assembled to form circular 152 or oval 153 layouts such as in FIGS. 9 and 10, respectively. The boards 20 are assembled to form more complicated layouts such as multi-loop layouts 155 with including combinations of several symmetrical and irregular shaped loops as in FIG. 11. The geometry and symmetry of the boards 20 naturally guides the shape of the layout 150 so that spurs or offshoots link up with one or more other blocks in the layout in the flushly aligned, side-to-side manner to form various loop shapes. The layouts 150 can be symmetrical as in layouts 151, 153 and 155, but can be unsymmetrical or include unsymmetrical loops within the overall layout as in layout 155. This allows the game 10 to be played on city layouts 150 having a wide variety of linear, arced, circular, oval or irregular loop shapes, or any combination thereof. As players gain an understanding of the game 10, how to coordinate the movements of their pieces 100 and master one particular layout 150, they can continuously challenge themselves by altering the layout to increasing its complicity.

Figure 8:
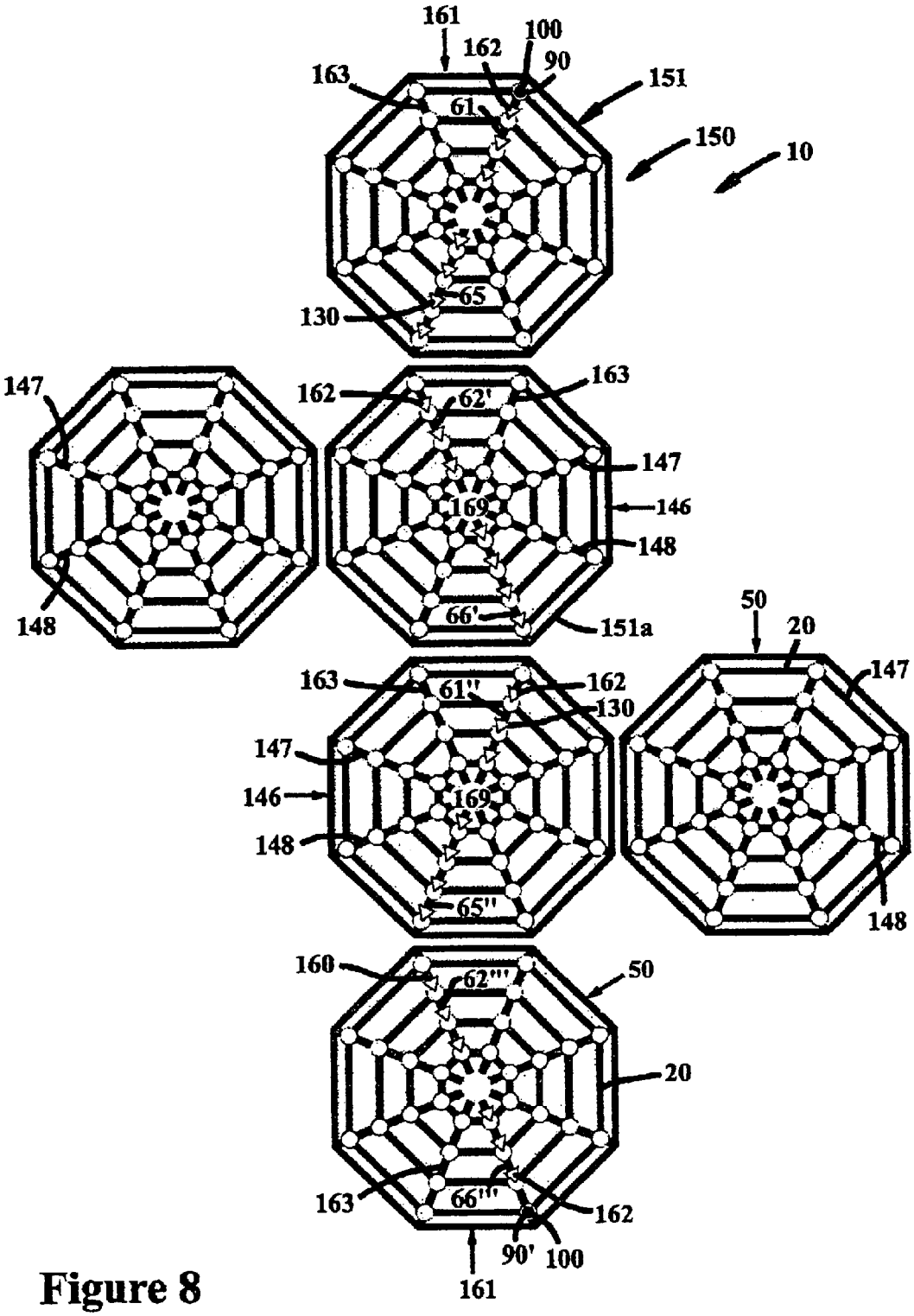
FIG. 8 is a top view showing a first multi-board battlefield layout having a linear section with two crisscrossing elongated radial paths that allow pieces to rapidly move from one end of the city battlefield layout to the other.
Figure 9:
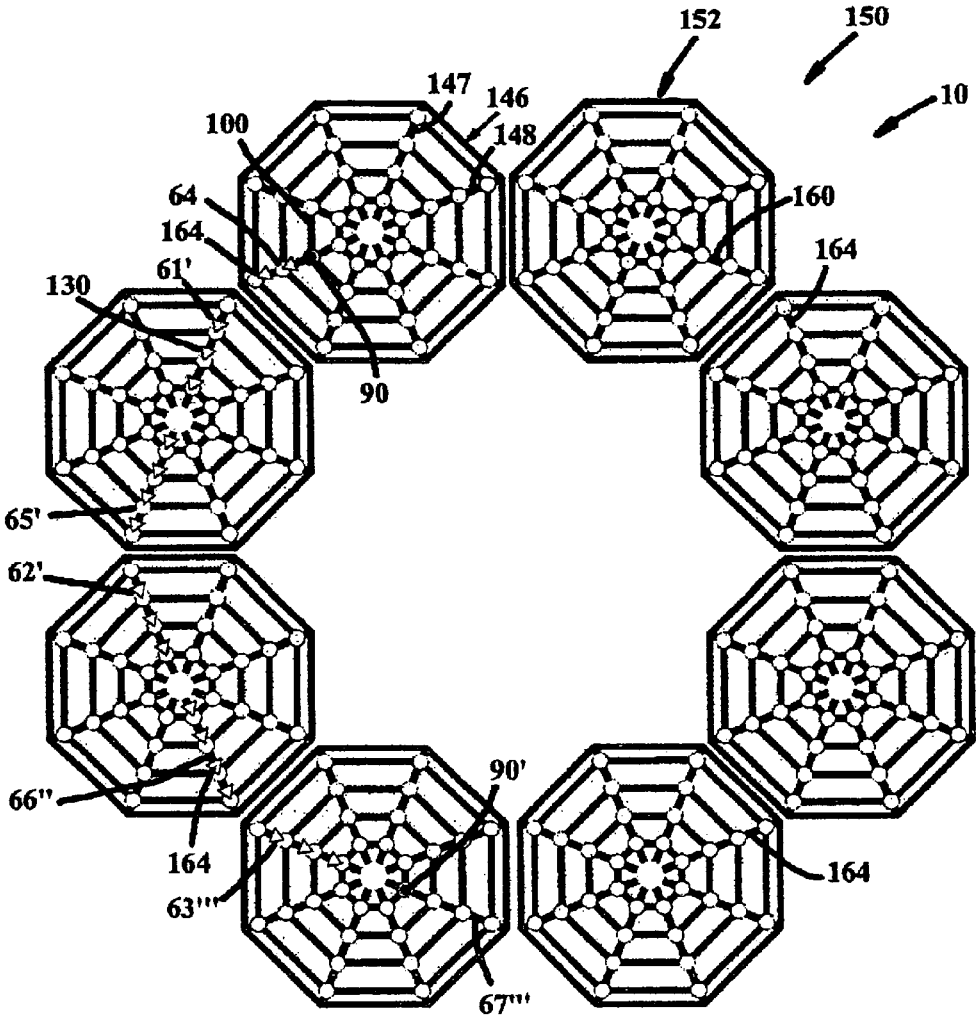
FIG. 9 is a top view showing a second multi-board battlefield layout having a circular shape with one curved elongated radial path that extends completely around the layout and allows playing pieces to rapidly move around the layout.

Layouts 150 are typically assembled to interconnect a series of opposed radial paths to form one or more elongated paths or roadways 160 that allow the pieces 100 to move extended distances in a single turn. These elongated paths 160 can extend from one end or area of the layout 150 to another. The elongated paths 160 can be substantially straight across the layout 150 from one side to an opposed side such as linear paths 61, 65, 62' and 66', 61", 65", etc., in FIG. 8, or arc across or around the board in a curved manner such as arcuate paths 64, 61', 65', 62", 66", etc. in FIG. 9. The linear portion 151*a* of the layout 151 shown in FIG. 8 is formed by four boards 20 placed on diametrically opposed sides 24 of their adjacent boards. The elongated paths 160 take the form of a pair of substantially straight crisscrossing elongated radial paths 161. The pair of crisscrossing paths 161 includes elongated radial path 162 and 163 that extend from one side of the linear portion 151*a* of the layout 150 to the other in a substantially linear or pseudo-linear manner. In the circular layout 152 in FIG. 9, one elongated path 164 forms a circle that extends completely around the layout. In the loop layouts 153 and 155 in FIGS. 10 and 11, there are several arcuate elongated paths 165 of varying length.

The elongated paths 160 create roadways for rapidly moving pieces from one side or location of the city battlefield 150 to the other. Controlling the positions 90 on or adjacent to these paths 160 provides strategic advantages for rapidly deploying pieces 100 around the city 150 and defending against attacks by the opposing pieces. City layouts 150 can be arranged where one or more elongated paths 160 intersect as in FIGS. 8, 10, and 11. Two paths 160 intersect at the center 22 or 52 of one board 20 or matrix 50. Controlling the positions 90 around these points of intersecting paths 169 provide further strategic advantages for deploying pieces 102 around the city 150 and defending against attacks by the opposing pieces 104.

Figure 10:
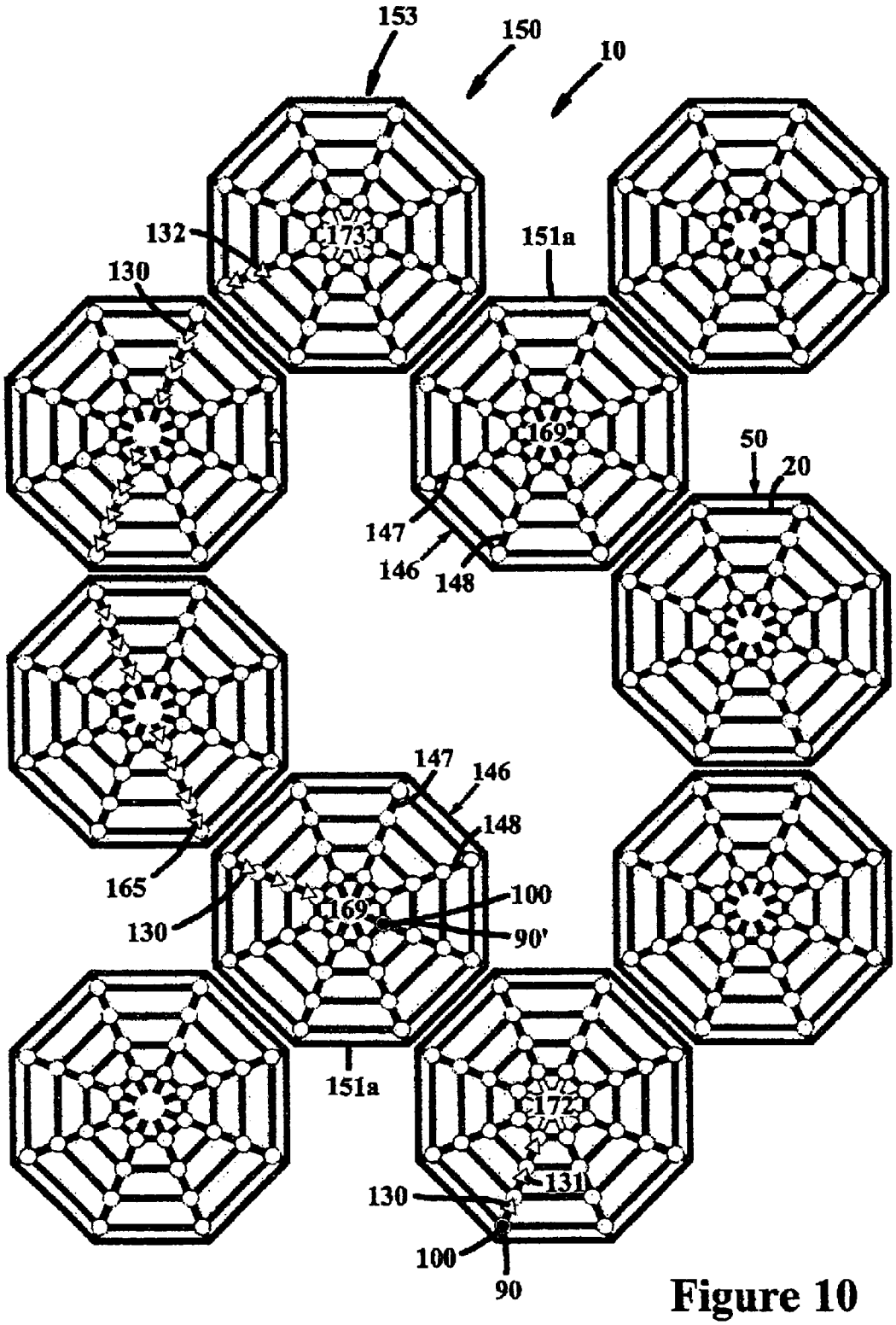
FIG. 10 is a top view showing a third multi-board battlefield layout having an oval shape with several elongated radial paths and one set of two transport towers that allow the pieces to rapidly move or disburse from one side or region of the layout to another.
Figure 11:
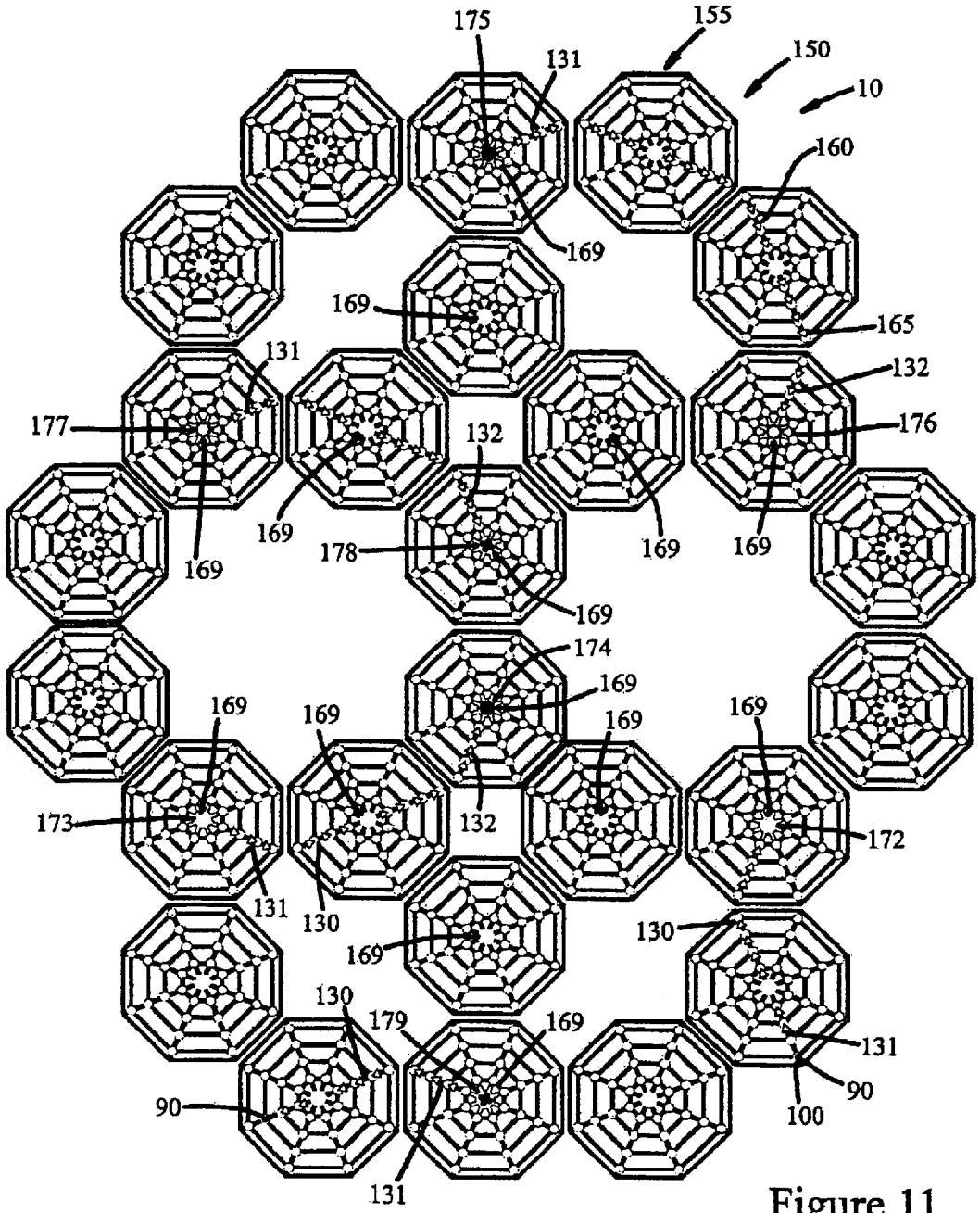
FIG. 11 is a top view showing a fifth multi-board battlefield layout having multiple symmetrical and irregular shaped loops with several elongated radial paths and four sets of transport towers, and with piece moving along a selected path of travel including various elongated paths and the four sets of transport towers to move from one side or region of the layout to another.

Transport towers 170 provide additional mechanisms or portholes that connect potentially isolated regions of the city layout 150 as shown in FIGS. 10 and 11. One set of transport towers 170 includes two separate towers 172 and 173, 174 and 175, 176 and 177, or 178 and 179. Each tower 170 is placed at the center 52 of one of two different matrixes 50. The squibb 100 must stop at the position 90 on the inner latitudinal path 71 adjacent one of the towers 170, or enter the tower and exit its corresponding towers. Each set of transport towers 170 is two directional. The squibbs 100 can travel through them both ways. Pieces 100 moving in the inward direction 121 along one of these two matrixes 50 and entering one tower 172 or 173 must exit its corresponding tower 173 or 172 in the same turn. Pieces 100 that exit one of the transport towers 172 or 173 continue in the outward direction 122 along any radial path 60 in the matrix 50 containing the exit tower. The piece 100 can end on any position 90 on any chosen radial path 60, or continue along any elongated path 160 connected to that matrix during that same turn, without passing over another piece. Controlling the positions 90 around one of the towers 172 or 173 of a set of towers 170 provides strategic advantages or rapidly deploying pieces 100 around the city 150 and defending against attacks by the opposing pieces.

Figure 12A:
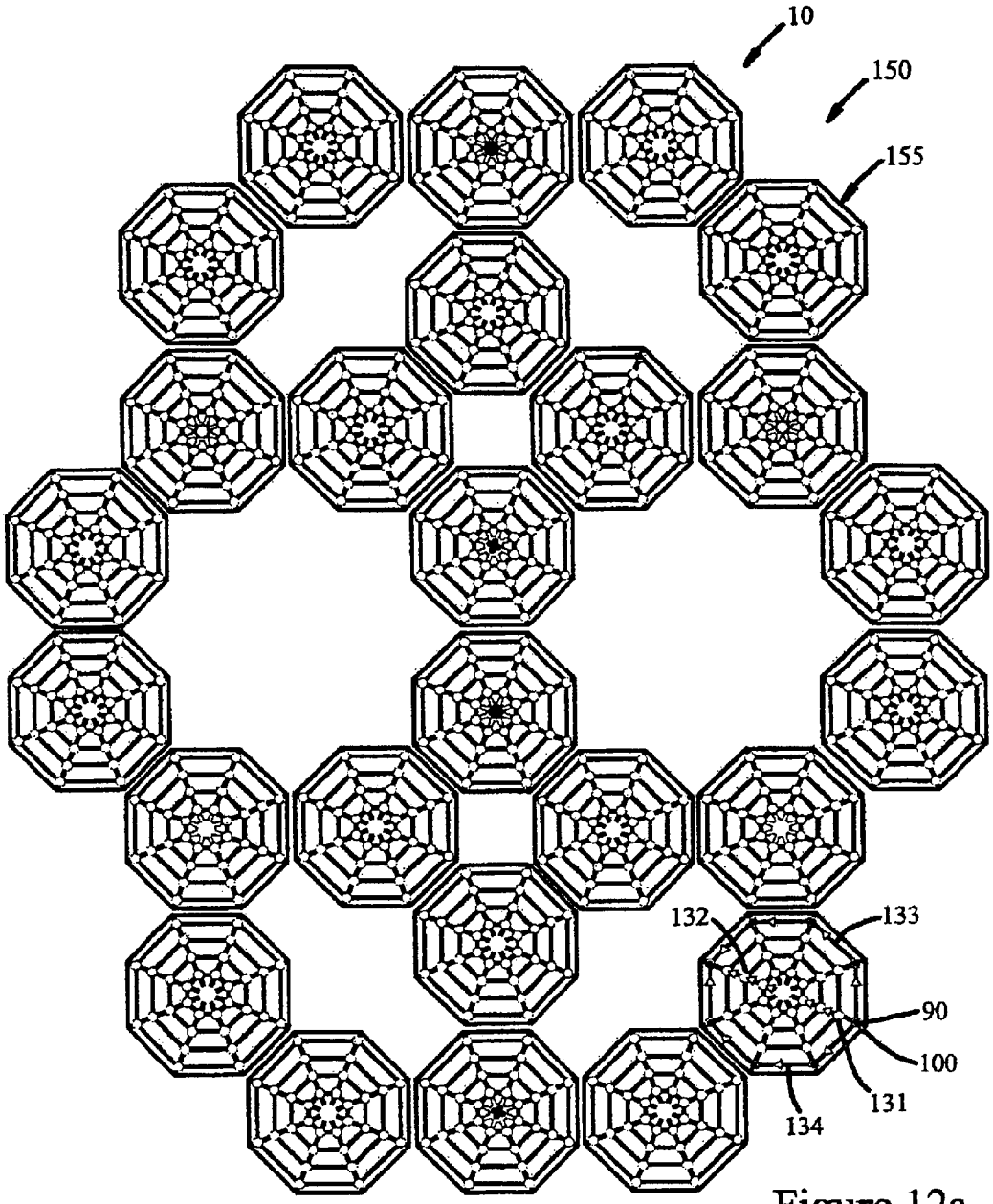
FIG. 12*a* is a top view of the fifth multi-board battlefield layout showing the possible paths of travel available to a first piece at a first particular position.
Figure 12B:
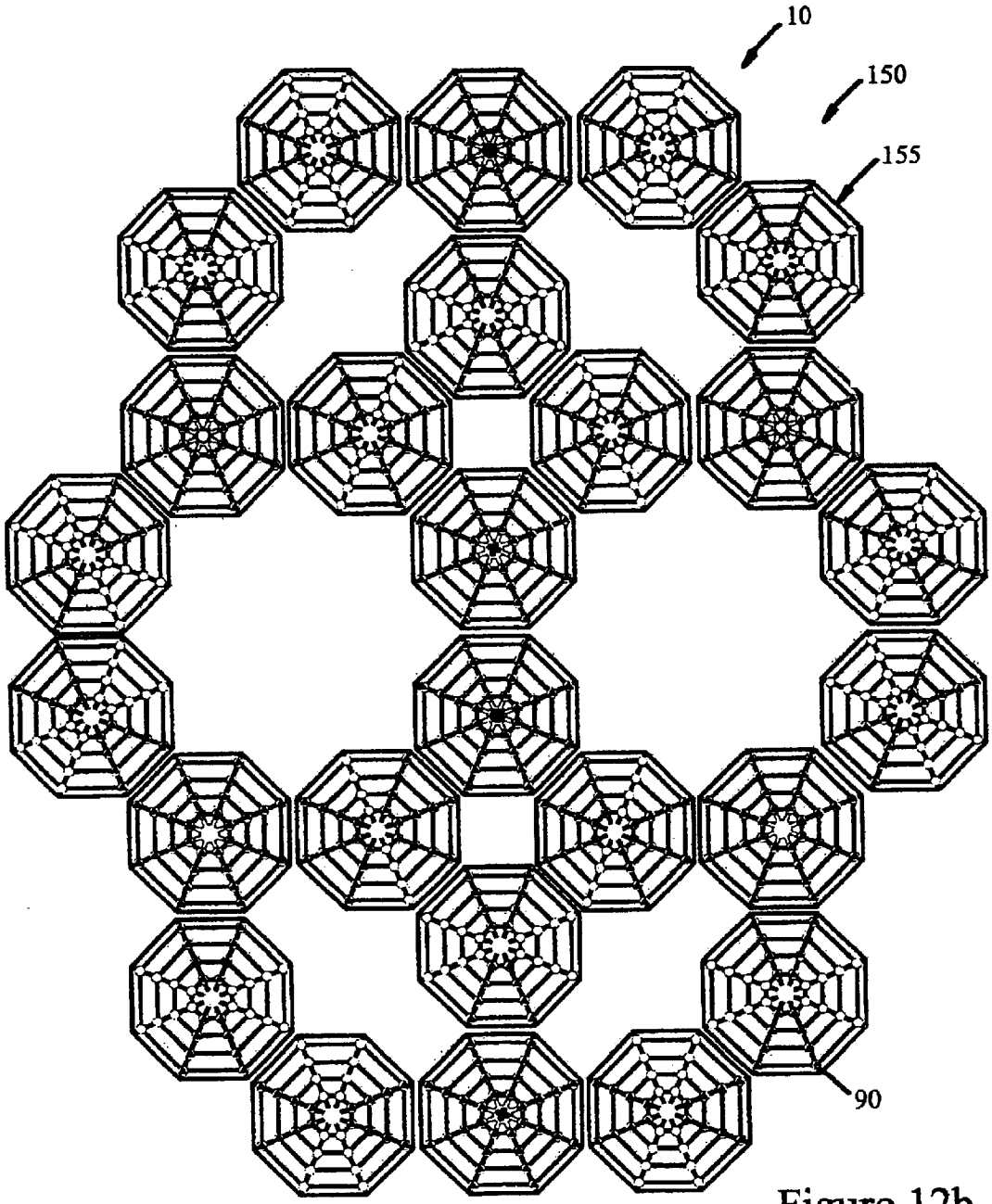
FIG. 12*b* is a top view of the fifth multi-board battlefield layout showing the possible paths of travel available to the first piece at a second particular position.
Figure 12C:
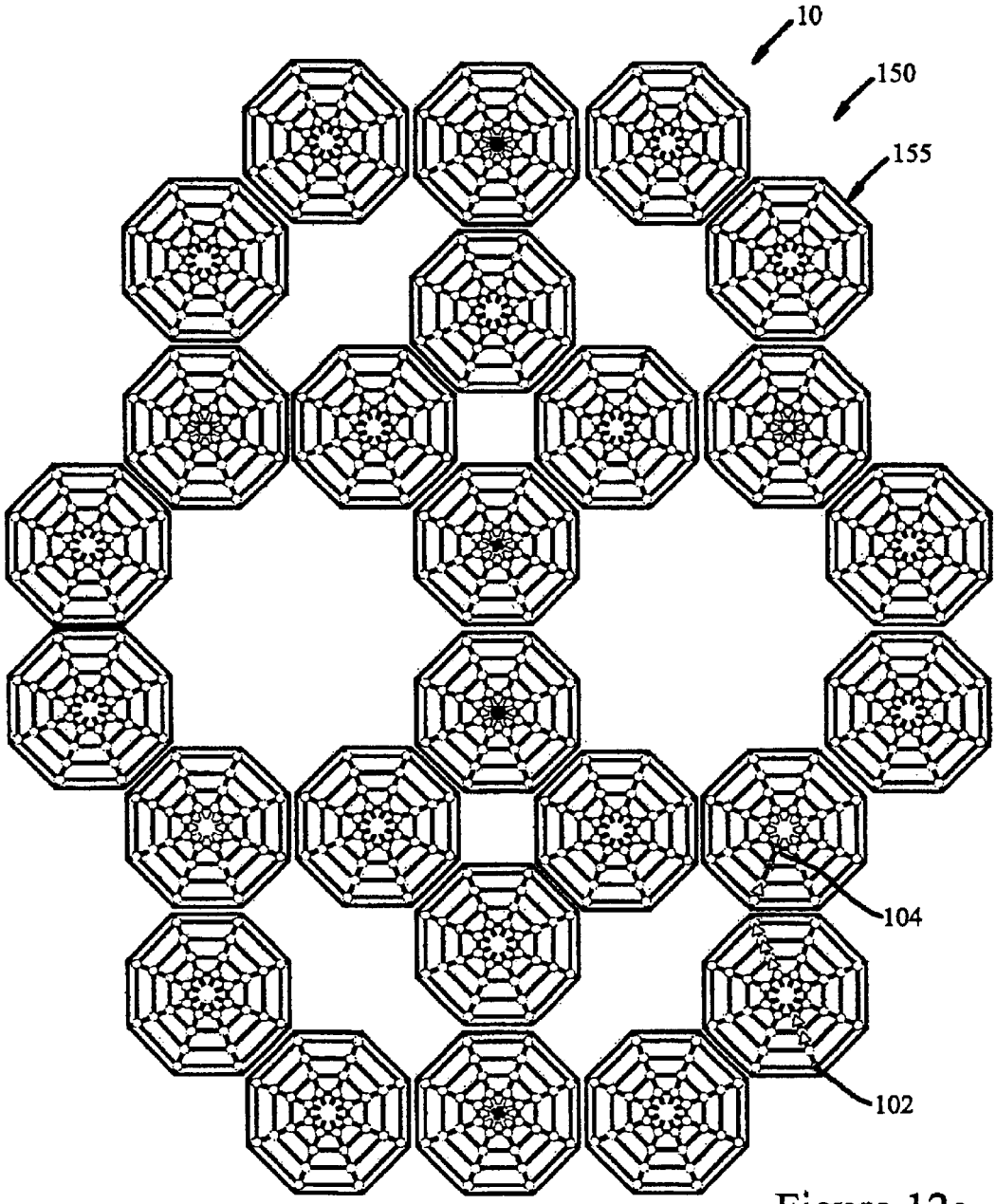
FIG. 12*c* is a top view of the fifth multi-board battlefield layout showing the possible paths of travel available to the first piece at the second particular position with most of its possible paths of travel being blocked by a second piece.

Although each piece 100 has the same strength and moves according to the same guidelines, the possible paths of travel for a given piece change when it moves from one position 90 to another. The piece 100 at the position 90 not on one of the crisscrossing radial paths 146 or a board 20 with a tower 170 such as in FIG. 12*a* is limited to possible paths of travel on that board. The piece 100 can only potentially be move to one of the darkened positions. Yet, moving the piece 102 even a single latitudinal segment to a position on a crisscrossing radial path 146 or an elongated radial path 160 such as in FIG. 12*b* can dramatically increase the possible paths of travel that are potentially available to that piece. Now the piece 100 can potentially reach most of the positions in the layout 150. By analogy to the game of chess, a piece 100 can be a pawn or a queen depending on the position 90 it occupies. As noted above, the permitted paths of travel available to the piece 102 at a given position 90 change during the course of the game 10 depending on the locations of the other pieces 102 or 104 on the board 20 or layout 150 such as in FIG. 12*c*. The piece 104 blocks most of the possible paths of travel of piece 102 so that piece 102 can only reach the darkened positions. The ever changing mobility of the pieces 100 depending on their positions 90, as well as the fluctuations in the permitted paths of travel of those positions depending on the location of the other pieces on the layout creates a dynamic game 10 that continuously challenges the players.

Any number of players can play the game 100 by increasing the number of boards 20 or matrixes 50. The same rules for moving and capturing pieces apply when there are three or more players. Players can be divided into two opposing teams for Tidron play. The first or Vandorian team battles the second or Tanangg team. Each team preferably has three players, and each player has a Paidron of nine pieces 100. Tidron play takes place on city layouts 150 as described above. Opposing teams face off their Paidrons in battles until one of the armies has been captured or time has run out. Paidrons must coordinate their strategies and attack together as a Tidron.

The rules for Tidron play are the same as for two players, with a couple of exceptions. As with single game play, at the start of the game 10, one player from one team or army holds one of the squibb 100 from each army in a different hand held behind his or her back. One of the players on the opposing team or army chooses a hand. The squibb's army that is chosen gets the first Paidron placement and first attack. The Paidrons are placed anywhere in the city with the provisions that: 1) each Paidron is placed in a three by three block or cluster, 2) they are placed such that three of the squibbs are on the outer ring of the hive, and 3) the Paidron cannot block the pathways 147 and 148 where abutting hives 50 and 50' are connected. The order of the Paidron placement is staggered. If one of the Vandorian Paidrons is placed first, then one of the Tanangg Paidrons is placed second, Vandorian third and so on until all of the Paidron have been placed on the city layout 150.

Each Paidron is allowed one move per Paidron team turn. Each of the players can only move their own Paidron pieces 100, but he or she may consult with other players on their team even if all of his or her squibbs have been captured. If there are five Paidrons is only allowed three moves per turn. So it is desirable to gang up and isolate and capture one Paidron at a time. Paidron leaders can move their squibbs 100 in any order, whichever order is most advantageous for their turn or attack. Players cannot move the same piece 100 more than once in a given turn. Captured squibbs 100 are removed from the board 20 the moment they are captured or killed. The attacking team can move its pieces 100 onto or over the position previously occupied by the captured piece 104 during that turn. Teams can coordinate their movements to open up blocked pathways for another of its Paidron's squibb 100 to use in the same turn or attack. Tidron city play opens up so many possibilities for the squibbs 100 to travel that they can get into and out of trouble very quickly.

The game 10 can be played on boards 20 with electric circuitry and lights that illuminate the adjacent radial and latitudinal paths 60 and 70 for each piece 100 on the board. The adjacent paths 60 and 70 for the positions 90 occupied by the pieces 102 of one player or Paidron are illuminated red. The adjacent paths 60 and 70 for the positions 90 occupied by the second player or Paidron are illuminated green. When the pieces 102 are moved to a position 92*a*, 92*b*, 94*a* or 94*b* adjacent one of the opposing pieces 104, or visa versa, the connecting pathway is illuminated orange. This helps the players know when two pieces 102*a* and 102*b* are flanking an opposing piece 104. The electronic board shows an orange light beam that goes in one side of the flanked or captured squibb 100 and out the other. Flanked squibbs 100 have orange light beams on opposed sides, and are removed from the board 20.

While the invention has been described with reference to a preferred embodiment, it will be understood by those skilled in the art that various changes may be made and equivalents may be substituted without departing from the broad aspects of the invention.

What is claimed is:

1. A war strategy game comprising:

a playing surface that forms first and second polar matrixes, each of said matrixes having substantially radial paths and substantially latitudinal paths, each of said matrixes having a center and a perimeter, each of said radial paths extending between said center and said perimeter of its said matrix, said paths on said first matrix defining a first array of occupiable positions, and said paths on said second matrix defining a second array of occupiable positions, each of said occupiable positions having at least one set of opposed adjacent positions, and said perimeters of said matrixes being adapted to align to form at least one set of aligned radial paths between said matrixes, said set of aligned radial paths including an aligned radial path from each of said matrixes;

a set of first and second transporters, said first transporter being located on said first matrix, and said second transporter being located on said second matrix, a plurality of first and second markers, each of said markers having an occupied position located at one of said occupiable positions, and said arrays including several unoccupied positions; and, wherein each of said markers is movable from its said occupied position along a path of travel including one of either one said radial paths and one of said latitudinal paths to one of said unoccupied positions, said path of travel of one of said markers at one of said positions on said set of aligned radial paths including movement between said first and second polar matrixes along said set of aligned radial paths, and said transporters allowing permissible paths of travel that include movement between each of said positions of said first matrix and any of said positions of said second matrix, and wherein said first markers capture one of said second markers when said first markers occupy said at least one set of opposed adjacent positions of that one said second marker, and said second markers capture one of said first markers when said second markers occupy said at least one set of opposed adjacent positions of that one said first marker.

2. The war strategy game of claim 1, and wherein said mating alignment of said perimeters of said matrixes forms a second set of aligned paths between said matrixes, said path of travel of said markers at one of said positions on said second set of aligned radial paths including movement between said first and second polar matrixes along said second set of aligned radial paths.

3. The war strategy game of claim 1, and further comprising a third polar matrix having substantially radial and substantially latitudinal paths, said matrix having a center and a perimeter, each of said radial paths extending between said center and said perimeter, said paths defining an array of occupiable positions; and, wherein said perimeters of said second and third matrixes are adapted to align to form at least one set of aligned radial paths between said second and third matrixes, said at least one set of aligned radial paths including one of said radial paths from each of said second and third matrixes, and said path of travel of said markers at one of said positions on said at least one set of aligned radial paths including movement between said second and third matrixes along said at least one set of aligned radial paths.

4. The war strategy game of claim 3, and wherein said mating alignment of said second and third matrixes forms a second set of aligned paths between said second and third matrixes, each of said two sets of aligned radial paths between said second and third matrixes including an aligned radial path from each of said second and third matrixes, and said path of travel along either of said aligned radial paths in said two sets of aligned radial paths including movement between said second and third matrixes.

5. The war strategy game of claim 1, and wherein said radial paths extend from said center to said perimeter, and each of said occupiable positions in one of said matrixes is in one of said radial paths.

6. The war strategy game of claim 5, and wherein each of said latitudinal paths has an equal number of occupiable positions, and each of said radial paths has an equal number of occupiable positions.

7. The war strategy game of claim 1, and wherein at least one of said radial paths of each of said matrixes has an opposed radial path, said at least one radial path and its said opposed radial path combining to form an opposed pair of radial paths joined at said center of said matrix, and said path of travel including movement over said center between said opposed pair of radial paths.

8. The war strategy game of claim 7, and wherein each of said radial paths has a substantially linearly aligned opposed radial path.

9. The war strategy game of claim 8, and wherein each of said occupiable positions has a diametrically opposed position on its said opposed radial path, and said path of travel is selected from one of three possible paths of travel from each position to its said diametrically opposed position.

* * * * *